US008920623B2

(12) United States Patent
Luo et al.

(10) Patent No.: US 8,920,623 B2
(45) Date of Patent: Dec. 30, 2014

(54) METHOD FOR REPLENISHING TIN AND ITS ALLOYING METALS IN ELECTROLYTE SOLUTIONS

(75) Inventors: Yu Luo, Acton, MA (US); Neil D. Brown, Merrick, NY (US); Michael P. Toben, Smithtown, NY (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 644 days.

(21) Appl. No.: 12/589,302

(22) Filed: Oct. 21, 2009

(65) Prior Publication Data

US 2010/0116674 A1 May 13, 2010

Related U.S. Application Data

(60) Provisional application No. 61/196,900, filed on Oct. 21, 2008.

(51) Int. Cl.

| | |
|---|---|
| ***C25D 21/18*** | (2006.01) |
| ***C25D 3/30*** | (2006.01) |
| ***C25D 3/60*** | (2006.01) |

(52) U.S. Cl.

CPC .. *C25D 3/30* (2013.01); *C25D 3/60* (2013.01); *C25D 21/18* (2013.01)

USPC ..... 205/101; 205/254

(58) Field of Classification Search

USPC ..... 205/101

See application file for complete search history.

(56) References Cited

U.S. PATENT DOCUMENTS

| | | | | |
|---|---|---|---|---|
| 3,793,165 | A | 2/1974 | Juda et al. | |
| 4,012,331 | A | 3/1977 | Jayne et al. | |
| 4,039,586 | A | 8/1977 | Shasha et al. | |
| 4,181,580 | A * | 1/1980 | Kitayama et al. | 205/101 |
| 4,293,396 | A | 10/1981 | Allen et al. | |
| 4,401,523 | A * | 8/1983 | Avellone | 205/96 |
| H36 | H * | 3/1986 | Smith | 205/81 |
| 4,614,575 | A | 9/1986 | Juda et al. | |
| 4,789,439 | A | 12/1988 | Bunk et al. | |
| 4,871,429 | A | 10/1989 | Nobel et al. | |
| 5,082,538 | A | 1/1992 | Derespiris et al. | |
| 5,094,726 | A | 3/1992 | Nobel et al. | |
| 5,174,887 | A | 12/1992 | Federman et al. | |
| 5,312,539 | A * | 5/1994 | Thomson | 205/101 |
| 5,378,347 | A | 1/1995 | Thomson et al. | |
| 5,412,051 | A | 5/1995 | McCallum, III et al. | |
| 5,667,849 | A * | 9/1997 | Carey et al. | 427/431 |
| 5,766,440 | A | 6/1998 | Ino et al. | |
| 6,899,803 | B2 | 5/2005 | Matejat et al. | |
| 7,151,049 | B2 * | 12/2006 | Beica et al. | 438/612 |
| 2001/0017266 | A1 * | 8/2001 | Maresch et al. | 205/81 |
| 2003/0070933 | A1 * | 4/2003 | Crotty | 205/253 |
| 2004/0000491 | A1 | 1/2004 | Kovarsky et al. | |
| 2004/0026255 | A1 | 2/2004 | Kovarsky et al. | |
| 2005/0082172 | A1 * | 4/2005 | Kovarsky et al. | 205/101 |
| 2009/0026083 | A1 * | 1/2009 | Tachibana et al. | 205/101 |

FOREIGN PATENT DOCUMENTS

| | | | |
|---|---|---|---|
| DE | 103 42 291 | A1 | 4/2005 |
| DE | 10342291 | A1 * | 4/2005 |
| JP | 61041799 | A | 2/1986 |
| JP | 04371599 | A | 12/1992 |
| JP | 05295588 | A | 11/1993 |
| JP | 06057499 | A | 3/1994 |
| WO | WO 2008/016541 | | 2/2008 |

OTHER PUBLICATIONS

Dr. Manfred Jordan, "The Electrodeposition of Tin and Its Alloys", Eugen G. Leuze-Publishers D-88348 Saulgau/Wurtt, Germany, ISBN 3-87480-118-7, p. 317.

European Search Report of corresponding European Application No. 09 15 5463.

* cited by examiner

*Primary Examiner* — Bryan D. Ripa

(74) *Attorney, Agent, or Firm* — John J. Piskorski

(57) ABSTRACT

Methods are disclosed for replenishing tin and its alloying metals in an aqueous electrolytic plating bath using an acidic solution containing stannous oxide. During electroplating of tin or tin alloys the stannous ions and alloying metal ions are depleted. To maintain continuous and efficient electroplating processes predetermined amounts of the plating bath containing tin and its alloying metals are bailed out. The bail out is then mixed with a predetermined amount of acidic solution containing stannous oxide and any alloying metals. The mixture is then retuned to the plating bath to return the stannous ions and alloying metal ions to their steady state concentrations.

5 Claims, No Drawings

METHOD FOR REPLENISHING TIN AND ITS ALLOYING METALS IN ELECTROLYTE SOLUTIONS

The present invention is directed to a method of replenishing tin and its alloying metals in electrolyte solutions. More specifically, the present invention is directed to a method of replenishing tin and its alloying metals in electrolyte solutions by replenishing tin ions using stannous oxide.

Maintaining efficient replenishment of tin electroplating bath components when insoluble anodes are employed, such as tin ions, alloying ions and electrolytes as well as other bath additives has been a challenging problem in the tin industry for many years and continues to be a problem to date. During electroplating, tin as well as other electroplating bath components are continuously being depleted from the electroplating bath or break down over time and require replenishing in order to maintain a consistent electroplating process. This is important on an industrial scale where electroplating may be done continuously over several days, weeks, months or years. Inefficient bath replenishment results in an overall inefficient electroplating process and inconsistent quality of tin and tin alloy deposits. This is neither cost effective for the tin electroplating business nor the user.

Numerous efforts have been made over the years to address the replenishment problem. For example, U.S. Pat. No. 4,181,580 describes a process for electrotinning steel strip in an electrolytic bath. The steel strip is the cathode and the anode is an insoluble metal plate positioned in the bath. The patent discloses several advantages achieved by the use of an insoluble anode rather than a soluble anode. However, an insoluble anode requires that the tin in the electrolytic bath be replenished. In U.S. Pat. No. 4,181,580, this is accomplished by withdrawing electrolyte from the electrolytic bath to a reactor which is exterior to the bath. The reactor contains a bed of tin in particulate form. Oxygen is introduced into the reactor and reacts with the tin to dissolve the tin. The rate of dissolution of the tin is controlled by the amount of oxygen which is introduced into the reactor. The rate of dissolution maintains the concentration of dissolved tin in the electrolytic bath at a desired level.

A primary problem with this process is that the oxygen also promotes the reaction of dissolved $Sn^{2+}$ (stannous) to $Sn^{4+}$ (stannic) such that an amount of dissolved tin ions is converted into sludge (stannic tin oxide) which has to be removed from the electrolyte. This requires the use of a separate sludge removal system.

U.S. Pat. No. 4,789,439 discloses a process which purports to avoid the need for a sludge removal system. In this process, electrolyte is withdrawn from an electrolytic tinning bath and is fed into an anode chamber of an electrolytic cell. The anode chamber contains a bed of tin particles. The cathode and anode chambers are separated by a tin impermeable membrane. A power source connected to the electrolytic cell provides an electric current by which tin ions are formed electrolytically in the reaction: $Sn \rightarrow Sn^{2+} + 2e^-$ and are added to the electrolyte.

One problem with this process is that an external power source is needed to drive the reaction and this adds to the cost of electrotinning. In addition, efficient operation of the electrolytic cell requires that the tin particles be in "good" contact with each other for the flow of current. If the particles are not in good contact, the cell resistance is increased. This causes the potential at the anode to increase, which can result in the evolution of oxygen at the anode and formation of $Sn^{4+}$ and tin sludge.

U.S. Pat. No. 5,082,538 discloses a process for replenishing tin in electrolytes and allegedly addresses the problem of sludge formation using a complex combination of electroplating apparatus and replenishing apparatus. The electroplating apparatus includes an electrolyte housing with a tin plating bath. A cathode strip and insoluble anode are immersed in the electrolyte containing tin ions. Under the influence of an electric field between the cathode and the insoluble electrode, tin plating is done on the cathode strip. The anode may be a valve metal substrate, such as titanium coated with an electrocatalytic layer, such as with a precious metal or mixed metal oxides, such as platinum, ruthenium, rhodium and iridium. As the tin is deposited on the cathode strip tin ions are being depleted from the electrolyte. Electrolyte depleted of tin ions is shunted to a reservoir where tin ions are replenished and then the electrolyte rich in tin ions is sent back to the electroplating apparatus. The reservoir is also in fluid communication with a replenishing apparatus which provides the reservoir with tin ions during the electroplating process.

The replenishing apparatus includes an electrolytic cell including a soluble tin anode in an anode chamber, a cathode in a cathode chamber and an electrolyte chamber between the tin anode and cathode chambers. The cathode is a gas diffusion electrode. An electrical circuit, usually having additional circuit resistance, connects the tin anode to the cathode. The circuit is free of connection to any external electrical power source. The electrolyte chamber has an electrolyte inlet and an electrolyte outlet which is in flow communication with the electrolytic tinning apparatus. The electrolytic cell receives at the inlet an electrolyte which is depleted in tin ($Sn^{2+}$) ions and provides at the outlet an electrolyte which is enriched in the $Sn^{2+}$. The gas diffusion electrode is exposed on its gas side to a source of gaseous fuel, such as oxygen.

When the soluble tin anode and the cathode are connected together electrically, a current is generated between the anode and the cathode. The current flow is at a current density which is effective to dissolve the tin of the tin anode into the electrolyte. Gaseous reactant, e.g. oxygen, is reduced to water at the cathode in an acidic electrolyte. Any oxygen which enters the cathode chamber is prevented from flowing to the anode by an air impermeable separator but allows tin ions to pass through. This allegedly prevents the undesired reaction of $Sn^{2+}$ to $Sn^{4+}$ and the formation of sludge.

Another problem associated with tin and tin alloy electroplating is the disruption of process steady state. During tin and tin alloy plating from acid electrolytes the free acid concentration continually increases while tin, alloying metals and other plating bath additives are depleted. Free acid is the quantity of acid in the electrolyte that is not associated with the tin ions. For example, in the case of tin ions in methane sulfonic acid, the $Sn^{2+}$ is stoichiometrically counterbalanced with $CH_3SO_3^{2-}$. This forms the basis of the tin methane sulfonate compound; however, it is necessary to add additional methane sulfonic acid to the electrolyte for electroplating. This additional acid that is in excess of the quantity required to form the tin methane sulfonate is called free acid.

If the tin and alloying metals are replenished with conventional acidic metal concentrates, eventually the acid concentration reaches a level that produces unacceptable plating performance. Rough and nodular deposits are typical indicators that the acid in the electrolyte is too high and the electroplating process is no longer operating at its initial steady state level. Workers in the tin electroplating industry have found maintaining the steady state of the tin and tin alloy electroplating difficult due to the continual buildup of acid concentration.

Although there are methods and apparatus for replenishing the loss of stannous ions from tin electroplating baths, there is still a need for an improved method of replenishing stannous ions which does not require a complex apparatus and at the same time prevents sludge formation (stannic oxide), and enables the maintenance of the electroplating process at steady state.

In one aspect a method includes: a) providing an electrolytic cell comprising an insoluble anode and a cathode; b) introducing a composition comprising one or more sources of stannous ions and one or more acid electrolytes or salts thereof into the electrolytic cell; c) electrically connecting the insoluble anode and the cathode to a power source and generating a current to flow at a current density effective to deposit tin on the cathode; d) removing a predetermined amount of the composition from the electrolytic cell by flowing the predetermined amount of the composition to a reservoir in fluid connection to the electrolytic cell; e) adding a predetermined amount of stannous oxide to the composition in the reservoir to form a mixture; and f) feeding the mixture into the electrolytic cell.

In another aspect a method includes: a) providing an electrolytic cell comprising an insoluble anode and a cathode; b) introducing a composition comprising one or more sources of stannous ions, one or more sources of alloying metals, and one or more acid electrolytes or salts thereof into the electrolytic cell; c) electrically connecting the insoluble anode and the cathode to a power source and generating a current to flow at a current density effective to deposit a tin alloy on the cathode; d) removing a predetermined amount of the composition from the electrolytic cell by flowing the predetermined amount of the composition to a reservoir in fluid connection with the electrolytic cell; e) adding a predetermined amount of stannous oxide and one or more sources of alloying metals to the composition in the reservoir to form a mixture; and f) feeding the mixture into the electrolytic cell.

The methods provide for a tin and tin alloy electroplating process which enables the maintenance of a steady state process and consistent tin and tin alloy deposits. Steady state is maintained by replenishing the tin or tin alloy electroplating bath with stannous oxide. The stannous oxide inhibits the continual rise of acid concentration in the electrolytic plating bath and at the same time replenishes the electroplating bath with tin and any alloying metals, thus maintaining the electroplating process in a steady state. Additionally, the tin and tin alloy electroplating compositions are substantially free of stannic oxide sludge formation typically formed in many tin and tin electroplating baths in conventional processes. Further, conventional electroplating apparatus may be used. In general, no additional devices or apparatus are needed to address the sludge formation problem. The methods are continuous methods and are suitable for industrial application.

As used throughout the specification, the following abbreviations have the following meaning, unless the context clearly indicates otherwise: ° C.=degrees Centigrade; gm=gram; mg=milligram; L=liter; mL=milliliter; UV=ultraviolet; A=amperes; Ahr/L=ampere hours/liter (indicates the amount of current per liter that passes through electroplating composition); m=meters; dm=decimeter; cm=centimeter; M=molar; terms "plating", "depositing" and "electroplating" are used interchangeably throughout the specification. Density of methane sulfonic acid=1.48 g/cm$^3$. All numerical ranges are inclusive and combinable in any order, except where it is logical that such numerical ranges are constrained to add up to 100%.

Tin is electroplated from aqueous compositions including one or more sources of stannous ions and one or more acid electrolytes or salts thereof. When a tin alloy is electroplated, the composition includes one or more sources of stannous ions, one or more sources of alloying metal ions and one or more acid electrolytes or salts thereof. The tin or tin alloy may be plated using conventional electroplating apparatus. The tin or tin alloy composition is contained in an electroplating cell which includes a cathode or substrate onto which the tin or tin alloy is deposited and an insoluble anode. The cathode and the insoluble anode are electrically connected to a current source such as a rectifier which provides and controls the current source to the electroplating cell. The electrolytic cell includes one or more output lines which are in fluid communication with one or more reservoirs. In addition, the electrolytic cells include one or more intake lines also in fluid communication with the one or more reservoirs.

During electroplating stannous ions, alloying metal ions as well as many other bath components are depleted and free acid concentration increases. Over time, if the metal ions are replenished with acidic metal concentrates, the electroplating process falls from steady state and substandard tin deposits are formed. This may be macroscopically observed by the tin and tin alloy deposits with non-uniform, rough and nodular surfaces. To avoid falling from steady state, a predetermined amount, also known in the industry as a bail out, of the electroplating composition is removed from the electroplating cell to the reservoir through one or more of the output lines. Conventional electric pumps pre-programmed for removing a predetermined amount of electroplating composition from the electroplating cell at predetermined periods of time to the reservoir may be used. At least one reservoir includes a solution of stannous oxide in predetermined amounts to replenish the bail out of the electroplating composition of stannous ions. Free acid from the electroplating composition solubilizes the stannous oxide. Alternatively, the stannous oxide may be added to the bail out of the electroplating composition already in the reservoir. The bail out of the electroplating composition and the stannous oxide are mixed to increase the depleted tin ions in the bail out and reduce the free acid. If the bail out is from a tin alloy composition, the reservoir also includes one or more sources of alloying metal ions to replenish such metal ions. The mixture with the replenished stannous ions and reduced free acid is then sent back to the electrolytic cell through the intake lines to maintain the electroplating process at steady state. The intake lines also are connected to electric pumps which are programmed to send the replenished composition back to the electrolytic cell at a given time period.

The predetermined amount of electroplating composition removed from the electroplating cell to the reservoir may vary depending on the make-up of the tin or tin alloy electroplating composition, such as stannous ion concentration, alloying metal ion concentration, acid electrolyte concentration and types and concentration of any optional additives included in the electroplating composition, such as complexing agents, chelating agents, brighteners, grain refiners, surfactants and levelers. Other parameters which may affect the amount of electroplating composition removed from the electroplating cell, include, but are not limited to the type of substrate to be plated, thickness of tin or tin alloy deposit desired and current density. Minor experimentation by workers in the industry may be done using their know-how and experience with tin and tin alloy electroplating compositions to determine amounts of electroplating composition to be replenished and to maintain the steady state of an electroplating method. In general, as much as 100% by volume of the electroplating composition may be removed and sent to the reservoir, replenished and fed to the electrolytic cell. Typically, from 1% by volume to 50% by volume, more typically from 5% by volume to 20% by volume is removed from the electrolytic cell.

Typically, stannous oxide alone is added to the bail out. Free acid in the electroplating composition keeps the stannous oxide in solution. Free acid concentration, typically, is at least 0.05 g/L, or such as from 0.05 g/L to 5 g/L, or such as from 1 g/L to 3 g/L. Alternatively, a replenishment solution may be added to the electroplating composition. The replenishment solution may include, in addition to stannous oxide and free acid, one or more salts of acids, and one or more sources of alloying metals when a tin alloy is being plated. Free acid is included to maintain a desired pH. Stannous oxide is included in the replenishment solution in amounts sufficient to replenish stannous ions in the electroplating composition and at the same time reduce the amount of free acid in the electroplating composition. In general, stannous oxide concentrations are at least 5 g/L to 100 g/L, or such as from 5 g/L to 80 g/L, or such as from 10 g/L to 70 g/L.

Alloying metal ions are included in the replenishment solution in sufficient amounts to replenish any alloying metal ions depleted in the electroplating composition. Alloying metal ions are provided as their aqueous soluble salts. In general, the same metal salt which is included in the electroplating composition is included in the replenishment solution; however, a different type of salt of the same metal may be used or mixtures of salts of the same metal. Salts of alloying metals may be included in the replenishment solution in amounts from 0.01 g/L to 10 g/L, or such as from 0.02 g/L to 5 g/L.

Optionally, other electroplating composition additives may be included in the stannous oxide replenishment solution provided that they do not cause any significant precipitation of stannous oxide from the replenishment solution to compromise the steady state electroplating method. Typically, such additives as brighteners, surfactants, complexing agents, chelating agents, anticorrosion agents and levelers are replenished by separate sources and reservoirs.

The replenishment method may be used to replenish stannous ions as well as alloying metal ions in conventional electroplating compositions. The electroplating tin compositions are typically free of cyanide.

The stannous ions in the electroplating compositions may result from the addition of any aqueous soluble tin compound to the electroplating compositions. Suitable aqueous soluble tin compounds include, but are not limited to, salts, such as tin halides, tin sulfates, tin alkane sulfonate, tin alkanol sulfonate, and their acids. When tin halide is used, it is typical that the halide is chloride. The tin compound is typically tin sulfate, or tin alkane sulfonate, and more typically tin sulfate or tin methane sulfonate. Such tin compounds are commercially available or may be prepared by methods known in the literature. Mixtures of aqueous soluble tin compounds may also be used.

The amount of tin compound useful in the electroplating compositions depends on the desired composition to be deposited and operating conditions. Typically, this is an amount that provides a stannous ion content in the range of 5 g/L to 100 g/L, more typically 5 g/L to 80 g/L and most typically 10 g/L to 70 g/L.

The one or more alloying metal ions are those useful in forming binary, ternary and higher order alloys with tin and those which are nobler than tin. Such alloying metals include, but not limited to, silver, gold, copper, bismuth, indium, lead and combinations thereof. Binary alloys include, but are not limited to, tin/silver, tin/gold, tin/copper, tin/bismuth, tin/indium and tin/lead. Ternary alloys include, but are not limited to, tin-silver-copper. The alloying metal ions may result from the addition of any aqueous soluble metal compound or mixture of aqueous soluble metal compounds of the desired alloying metal(s). Suitable alloying-metal compounds include, but are not limited to metal halides, metal sulfates, metal alkane sulfonates and metal alkanol sulfonates of the desired alloying metal. When a metal halide is used, it is typical that the halide is chloride. It is typical that the metal compound is a metal sulfate, a metal alkane sulfonate or a mixture thereof, and more typically a metal sulfate, a metal methane sulfonate or a mixture thereof. The metal compounds useful in the present invention are commercially available or may be prepared by methods described in the literature.

The amount of the one or more alloying metal compounds useful in the electroplating compositions depend, for example, on the desired composition of the film to be deposited and operating conditions. Typically, the amount provides an alloying metal ion content in the electroplating composition in the range of 0.01 g/L to 10 g/L, or such as 0.02 g/L to 5 g/L.

Any acid that is soluble in the electroplating composition and does not otherwise adversely affect the electroplating composition may be used. Acids include, but are not limited to, arylsulfonic acids, alkanesulfonic acids, such as methanesulfonic acid, ethanesulfonic acid and propanesulfonic acid, aryl sulfonic acids such as phenylsulfonic acid and tolylsulfonic acid, and mineral acids such as sulfuric acid, sulfamic acid, hydrochloric acid, hydrobromic acid, fluoroboric acid and salts thereof. Typically, alkane sulfonic acids and aryl sulfonic acids are used. Although a mixture of acids may be used, it is typical that a single acid is used. Such acids are commercially available or may be prepared by methods known in the literature.

While depending on the desired alloy composition and operating conditions, the amount of acid (total acid including free acid and acid associated with stannous ions and any other ions in the electroplating composition) in the electrolyte compositions may range from 0.01 g/L to 500 g/L, or such as 10 g/L to 400 g/L, or such as 100 g/L to 300 g/L. When the stannous ions and/or ions of the one or more alloying metal in the composition are from a metal halide compound, use of the corresponding acid may be desired. For example, when one or more of tin chloride, silver chloride or copper chloride are used, use of hydrochloric acid as the acid component may be desired. Mixtures of acids also may be used.

Complexing agents included in the compositions include, but are not limited to, thial and thiol. Typically, complexing agents are present in an amount of 0.01 g/L to 50 g/L, more typically from 2 g/L to 20 g/L.

Thial compounds are compounds which have the >C═S group attached to various organic moieties. This includes dithials which are compounds which have two >C═S groups attached to an organic moiety. Thials are well known in the art. Various examples may be found in the literature.

One type of thial is thiourea and thiourea derivatives. Thiourea derivatives which may be used in the electroplating compositions include, but are not limited to, 1-allyl-2-thiourea, 1,1,3,3-tetramethyl-2-thiourea, thiourea 1,3-diethyl, thiourea 1,3-dimethyl, thiourea 1-methyl, thiourea 1-(3-tolyl), thiourea 1,1,3-trimethyl, thiourea 1-(2-tolyl), thiourea 1,3-di(2-tolyl), and combinations thereof.

Thiol compounds are compounds which have the —S—H group attached to various organic moieties. The latter can be, for example, an aryl group as in the case of thiophenol or a substituted aryl group as in the case of p-toluenethiol and thiosalicylic acid (o-mercaptobenzoic acid). Typically, thiol compounds are those in which the —S—H group is attached to an aliphatic moiety. The aliphatic moiety may bear substitutents additional to the thiol group. If the thiol compound includes two —S—H groups, it is known as a dithiol. Thiols are well known in the art. Various examples may be found in the literature.

The electroplating compositions may further include one or more additives selected from alkanol amines, polyethylene imines, alkoxylated aromatic alcohols, and combinations thereof. Combinations of two or more different additives within or among these groups may be used. Such additives may be present in an amount of 0.01 g/L to 50 g/L, or such as from 2 g/L to 20 g/L.

Examples of alkanol amines include substituted or unsubstituted methoxylated, ethoxylated, and propoxylated amines, for example, tetra (2-hydroxypropyl)ethylenediamine, 2-{[2-(Dimethylamino)Ethyl]-Methylamino}Ethanol, N,N'-Bis(2-Hydroxyethyl)-ethylenediamine, 2-(2-Aminoethylamine)-Ethanol, and combinations thereof.

Examples of polyethyleneimines include substituted or unsubstituted linear or branched chain polyethyleneimines or mixtures thereof having a molecular weight of from 800-750,000. Substituents include, for example, carboxyalkyl, for example, carboxymethyl, carboxyethyl.

Useful alkoxylated aromatic alcohols include, for example, ethoxylated bis phenol, ethoxylated beta naphthol, and ethoxylated nonyl phenol.

Optionally, one or more antioxidant compound may be included in the electrolyte compositions. Suitable antioxidant compounds are known to those skilled in the art and are disclosed, for example, in U.S. Pat. No. 5,378,347. The antioxidant compounds typically include, for example, multivalent compounds based on the elements of groups IV B, V B, and VI B in the Periodic Table of the Elements, such as those of vanadium, niobium, tantalum, titanium, zirconium and tungsten. Of these, multivalent vanadium compounds, such as vanadium whose valences are $5^+$, $4^+$, $3^+$, $2^+$, are preferred. Examples of useful vanadium compounds include vanadium (IV) acetyl acetonate, vanadium pentoxide, vanadium sulfate, and sodium vanadate. Such antioxidant compounds may be used in an amount of 0.01 g/L to 10 g/L, or such as from 0.01 g/L to 2 g/L.

A reducing agent may optionally be added to the electroplating compositions. Reducing agents include, but are not limited to, hydroquinone and hydroxylated aromatic compounds, such as resorcinol, catechol, and the like. Such reducing agents may be present in an amount of from 0.01 g/L to 10 g/L, or such as 0.1 g/L to 5 g/L.

For applications requiring wetting capabilities one or more wetting agents may be included in the electroplating compositions. Suitable wetting agents are known to those skilled in the art, and include any which yield deposits having satisfactory solderability, satisfactory matte or lustrous finish, satisfactory grain refinement, and are stable in the acidic electroplating compositions.

Brighteners may be included in the electroplating compositions. Suitable brighteners include, but are not limited to, aromatic aldehydes, such as chlorobenzaldehyde, or derivatives thereof, such as benzal acetone. Conventional amounts may be used and are known to those skilled in the art.

Other compounds may be added to the electroplating compositions to provide further grain refinement. Such other compounds may be added to the compositions to further improve deposit appearance and operating current density range. Such other compounds include, but are not limited to, alkoxylates, such as the polyethoxylated amines JEFFAMINE™ T-403 or TRITON™ RW, or sulfated alkyl ethoxylates, such as TRITON™ QS-15, and gelatin or gelatin derivatives. The amounts of such compounds are added in amounts of 0.1 mL/L to 20 mL/L, or such as 0.5 mL/L to 8 mL/L, or such as 1 mL to 5 mL/L.

The tin and tin alloy electroplating method may be used, for example, in horizontal or vertical wafer plating, barrel plating, and high speed plating. A tin or tin alloy may be deposited on a substrate by the steps of contacting the substrate with the tin or tin alloy composition described above and passing a current through the composition to deposit the tin or tin alloy on the substrate. Any substrate that can be electroplated with a metal is suitable for plating using the methods. Suitable substrates include, but are not limited to: copper, copper alloys, nickel, nickel alloys, nickel-iron containing materials, electronic components, plastics, and semiconductor wafers such as silicon wafers. Suitable plastics include plastic laminates, such as printing wiring boards, particularly copper clad printed wiring boards. The methods may be used for electroplating of electronic components, such as lead frames, semiconductor wafers, semiconductor packages, components, connectors, contacts, chip capacitors, chip resistors, printed wiring boards, and in wafer interconnect bump plating applications.

The current density used to plate the tin or tin alloy depends on the particular plating method. Generally, the current density is 1 A/dm$^2$ and greater, or such as from 1 A/dm$^2$ to 200 A/dm$^2$, or such as from 2 A/dm$^2$ to 30 A/dm$^2$, or such as from 2 A/dm$^2$ to 20 A/dm$^2$, or such as from 2 A/dm$^2$ to 10 A/dm$^2$, or such as from 2 A/dm$^2$ to 8 A/dm$^2$.

The electroplating and replenishment method is done at a temperature range of 15° C. to 70° C., more typically at room temperature. The pH of the electroplating and replenishment solutions is below 7, typically 1 or below.

The electroplating and replenishment method may be used to deposit tin-alloys of various compositions. For example, alloys of tin and one or more of silver, copper, gold, bismuth, indium or lead may contain 0.01 wt % to 25 wt % of the alloying metal(s) and 75 wt % to 99.99 wt % tin, or such as 0.01 wt % to 10 wt % of the alloying metal(s) and 90 wt % to 99.99 wt % tin, or such as 0.1 wt % to 5 wt % of the alloying metal(s) and 95 wt % to 99.9 wt % tin, based on the weight of the alloy, as measured by either atomic adsorption spectroscopy ("AAS"), x-ray fluorescence ("XRF"), inductively coupled plasma ("ICP") or differential scanning calorimetry ("DSC"). Such tin alloys are substantially free of cyanides.

Apparatus used in the electroplating and replenishment methods are conventional; however, insoluble anodes are used and soluble anodes, such as soluble tin anodes, are excluded. Soluble anodes may cause poor process control. For example, if a tin soluble anode is used when plating a tin/silver alloy, silver immersion may occur on the anode. Silver immersion is a spontaneous displacement reaction which occurs when silver ions come in contact with a more active metal such as tin. During the immersion reaction the more active metal is oxidized to a metal ion and the silver ion is reduced to silver metal. In the case of soluble tin anodes, the silver immersion causes loss of silver ions from the tin/silver bath resulting in poor process control.

Conventional insoluble anodes may be used. Examples of such conventional insoluble anodes are anodes that have surfaces with oxides of iridium and tantalum. Other examples of insoluble anodes include anodes composed of cobalt, nickel, ruthenium, rhodium, palladium, and platinum. Additionally, insoluble anodes of osmium, silver and gold or their oxides may be used.

The methods provide for a tin and tin alloy electroplating process which enables the maintenance of a steady state process. Steady state is maintained by replenishing the tin or tin alloy electroplating bath stannous oxide. The stannous oxide inhibits the continual rise of acid concentration in the electrolytic plating bath and at the same time replenishes the electroplating bath with tin and any alloying metals, thus maintaining the electroplating process in a steady state. Additionally, there is no observable sludge formation (stannic oxide) which is formed in many tin and tin electroplating baths in conventional processes. Further, conventional electroplating apparatus may be used; however, soluble anodes are excluded from the apparatus. No additional devices or apparatus are needed to address the sludge formation problem. The methods are continuous methods, they provide consistent tin and tin alloy deposits, and are suitable for industrial application.

The following examples are included to further illustrate the invention but are not intended to limit the scope of the invention.

EXAMPLE 1

Control

An aqueous tin/silver alloy electroplating composition was prepared having the components disclosed in Table 1 below.

TABLE 1

| COMPONENT | AMOUNT |
|---|---|
| Tin ions ($Sn^{2+}$) from tin methane sulfonate | 50 g/L |
| Methane sulfonic acid (70%) | 100 mL/L |
| Silver ions (Ag+) from silver methane sulfonate | 0.4 g/L |
| Ethoxylated beta Naphthol | 100 mL/L |
| Polyethyleneimine | 10 mL/L |
| 1-allyl-2-thiourea | 100 mL/L |
| Water | To 1 liter |

The composition was placed in a conventional electroplating cell with a mesh-type insoluble iridium oxide anode and the cathode was a 5 cm×5 cm patterned silicon wafer segment with a copper seed layer. The electrodes were joined in electrical communication with a conventional rectifier. The temperature of the composition during electroplating was maintained at 30° C. The pH of the electroplating composition was less than 1. The total acid content (free acid and acid associated with stannous ions) was 100 mL/L and remained constant throughout the deposition period. There was no indication that free acid increased significantly over the 25 minute period to compromise the steady state of the electroplating bath. The free methane sulfonic acid content was measured using conventional acid-base titration with 1M sodium hydroxide as the titrant.

Electroplating was done over 25 minutes at a current density of 6 A/dm$^2$. The tin/silver deposit was smooth and uniform without any observable nodules. The electroplating results showed that the electroplating composition was at a steady state during electroplating.

EXAMPLE 2

An initial tin/silver alloy electroplating composition having the identical components of the composition of Table 1, except that the total acid concentration was 200 mL/L, was placed into an electrolytic cell with a mesh-type insoluble iridium oxide anode and was electrolyzed with the insoluble iridium oxide anode to 1.13 Ahr/L. This directly correlates the amount of stannous ions that were lost due to electrolysis for the prescribed current and time. Based on the Ahr/L the amount of tin deposited over 1 hour of electroplating was determined to be 2.5 g. After 1 hour of electroplating, the composition was then analyzed for component content. Stannous ions were analyzed by the standard iodine titration method and found to be at a concentration of 47.5 g/L. This was the expected amount of stannous ions in the electroplating composition based on the amount of current passing through the composition. The concentration of the free methane sulfonic acid was determined using conventional acid-base titration with 1M sodium hydroxide. Silver ion concentration was analyzed by atomic absorption spectroscopy (AAS). The ethoxylated beta naphthol was analyzed using cyclic voltammetric stripping (CVS). The polyethyleneimine concentration was measured by solid phase extraction and UV-vis spectrophotometry. The concentration of the 1-allyl-2-thiourea was analyzed by conventional reverse titration method. Table 2 discloses the results of the analysis. The analysis indicated an increase in total acid from 200 mL/L to 204 mL/L. The increase in acid was due to an increase in free acid.

TABLE 2

| COMPONENT | AMOUNT |
|---|---|
| Tin ions ($Sn^{2+}$) from tin methane sulfonate | 47.5 g/L |
| Methane sulfonic acid (70%) | 204 mL/L |
| Silver ions ($Ag^{+}$) from silver methane sulfonate | 0.38 g/L |
| Ethoxylated beta Naphthol | 100 mL/L |
| Polyethyleneimine | 10 mL/L |
| 1-allyl-2-thiourea | 100 mL/L |
| Water | To one liter |

100 mL (10%) of the tin/silver electroplating solution were removed and placed into a beaker. 28.35 g/L of stannous oxide and 0.2 g/L of silver ions from concentrated silver methane sulfonate were added to the above solution in the beaker to form a mixture. The beaker containing the mixture was maintained at room temperature. There was no observable sludge at the bottom of the beaker. The composition was then analyzed for component concentration using the methods described above. The analysis results are disclosed in Table 3 below.

TABLE 3

| COMPONENT | AMOUNT |
|---|---|
| Tin ions ($Sn^{2+}$) from tin methane sulfonate and tin oxide | 72.5 g/L |
| Methane sulfonic acid (70%) | 200 mL/L |
| Silver ions ($Ag^{+}$) from silver methane sulfonate | 0.58 g/L |
| Ethoxylated beta Naphthol | 100 mL/L |
| Polyethyleneimine | 10 mL/L |
| 1-allyl-2-thiourea | 100 mL/L |
| Water | To 100 mL |

It was determined that 64 mL/L of acid out of the 200 mL/L of total acid was free acid. This maintained a pH of less than 1 to help stabilize the composition of Table 3. 100 mL of the composition from Table 3 were added into the 900 mL of the composition of Table 2. The resulting composition was then analyzed for the concentration of components. The composition had the concentration as disclosed in Table 4 below.

TABLE 4

| COMPONENT | AMOUNT |
|---|---|
| Tin ions ($Sn^{2+}$) from tin methane sulfonate and tin oxide | 50 g/L |
| Methane sulfonic acid (70%) | 200 mL/L |
| Silver ions ($Ag^{+}$) from silver methane sulfonate | 0.4 g/L |
| Ethoxylated beta Naphthol | 100 mL/L |
| Polyethyleneimine | 10 mL/L |
| 1-allyl-2-thiourea | 100 mL/L |
| Water | To one liter |

The stannous ion concentration was replenished to the level of the electroplating composition in the initial electroplating composition. Additionally, the free acid in the replenished electroplating composition decreased to 200 mL/L from 204 mL/L.

The composition was placed in a conventional electroplating cell with a mesh-type iridium dioxide anode and the cathode was a 5 cm×5 cm patterned silicon wafer segment with a copper seed layer. The electrodes were joined in electrical communication with a conventional rectifier. The temperature of the composition during electroplating was maintained at 30° C. The pH of the electroplating composition was less than 1.

Electroplating was done over 25 minutes at a current density of 6 A/dm$^2$. The tin/silver deposit was smooth and uniform without any observable nodules and identical to the tin/silver alloy plated from the control electroplating composition. Accordingly, stannous oxide was successfully used as a replenishment source of tin ions to maintain steady state electroplating conditions for tin/silver alloy deposition.

EXAMPLE 3

The method described in Example 2 is repeated except that the alloying metal is copper for depositing a tin/copper alloy. Copper ions are included in the electroplating composition in amounts of 1 g/L. The source of copper ions is form copper methane sulfonate. Replenishing stannous ion loss to the electroplating composition with stannous oxide is expected to provide a smooth and uniform tin/copper deposit without any nodules.

EXAMPLE 4

The method described in Example 2 is repeated except that 1 g/L of silver from silver methane sulfonate and 1 g/L of copper from copper methane sulfonate is included in the electroplating composition. Replenishing stannous ion loss to the electroplating composition with stannous oxide is expected to provide a smooth and uniform tin/silver/copper deposit without any nodules.

EXAMPLE 5

The method described in Example 2 is repeated except that the alloying metal is gold for depositing a tin/gold alloy. Gold ions are included in the electroplating composition in amounts of 10 g/L. The source of gold ions is from gold trichloride. Replenishing stannous ion loss to the electroplating composition with stannous oxide is expected to provide a smooth and uniform tin/gold deposit without any nodules.

EXAMPLE 6

The method described in Example 2 is repeated except that the alloying metal is bismuth for depositing a tin/bismuth alloy. Bismuth ions are included in the electroplating composition in amounts of 10 g/L. The source of bismuth ions is from bismuth ammonium citrate. Replenishing stannous ion loss to the electroplating composition with stannous oxide is expected to provide a smooth and uniform tin/bismuth deposit without any nodules.

EXAMPLE 7

The method described in Example 2 is repeated except that the alloying metal is indium for depositing a tin/indium alloy. Indium ions are included in the electroplating composition in amounts of 5 g/L. The source of indium ions is from indium sulfate. Replenishing stannous ion loss to the electroplating composition with stannous oxide is expected to provide a smooth and uniform tin/indium deposit without any nodules.

EXAMPLE 8

The method described in Example 2 is repeated except that the alloying metal is lead for depositing a tin/lead alloy. Lead ions are included in the electroplating composition in amounts of 2 g/L. The source of lead ions is from lead nitrate. Replenishing stannous ion loss to the electroplating composition with stannous oxide is expected to provide a smooth and uniform tin/lead deposit without any nodules.

What is claimed is:

1. A method comprising:

a) providing an electrolytic cell comprising an insoluble anode and a cathode;

b) introducing a composition comprising one or more sources of stannous ions and one or more sources of silver ions, free acid in amounts of 0.05 g/L to 5 g/L one or more acid electrolytes or salts thereof into the electrolytic cell;

c) electrically connecting the insoluble anode and the cathode and generating a current flow at a current density effective to deposit tin/silver alloy on the cathode; and increasing the free acid concentration of the composition;

d) removing a predetermined amount of the composition comprising the increased free acid from the electrolytic cell by flowing the predetermined amount of the composition comprising the increased free acid concentration to a reservoir in fluid communication to the electrolytic cell;

e) adding a predetermined amount of a solution, formed by the addition of stannous oxide in amounts of 5 g/L to 100 g/L, so as to provide tin ions and one or more sources of silver ions to provide silver ions in amounts of 0.01 g/L to 10 g/L to the composition comprising the increased free acid concentration in the reservoir to form a mixture; and f) feeding the mixture into the electrolytic cell.

2. The method of claim 1, wherein the electroplating composition further comprises one or more complexing agents.

3. The method of claim 2, wherein the one or more complexing agents are chosen from thiols and thials.

4. The method of claim 1, wherein the one or more acid electrolytes are chosen from alkane sulfonic acids, arylsulfonic acids, sulfuric acid, sulfamic acid, hydrochloric acid, fluoroboric acid and salts thereof.

5. The mthod of claim 1, wherein the cathode comprise copper, copper alloys, nickel, nickel alloys, plastics or silicon wafers.

* * * * *